US010180294B2

(12) United States Patent
Quintard et al.

(10) Patent No.: US 10,180,294 B2
(45) Date of Patent: Jan. 15, 2019

(54) DEVICE FOR DISPENSING JETS OF CRYOGENIC FLUID, INCLUDING A PLENUM CHAMBER

(71) Applicant: L'Air Liquide, Societe Anonyme Pour l'Etude et l'Exploitation des Procedes Georges Claude, Paris (FR)

(72) Inventors: Jacques Quintard, Presles (FR); Frederic Richard, Parmain (FR); Charles Truchot, Saint Nazaire (FR)

(73) Assignee: L'Air Liquide, Société Anonyme pour l'Etude et l'Exploitation des Procédés Georges Claude, Paris (FR)

( * ) Notice: Subject to any disclaimer, the term of this patent is extended or adjusted under 35 U.S.C. 154(b) by 1090 days.

(21) Appl. No.: 14/359,113

(22) PCT Filed: Oct. 23, 2012

(86) PCT No.: PCT/FR2012/052432
§ 371 (c)(1),
(2) Date: May 19, 2014

(87) PCT Pub. No.: WO2013/076395
PCT Pub. Date: May 30, 2013

(65) Prior Publication Data

US 2014/0352794 A1 Dec. 4, 2014

(30) Foreign Application Priority Data

Nov. 24, 2011 (FR) ..... 11 60727

(51) Int. Cl.
*F28G 1/16* (2006.01)
*F28G 1/12* (2006.01)
(Continued)

(52) U.S. Cl.
CPC ..... *F28G 1/16* (2013.01); *B24C 1/003* (2013.01); *B24C 1/086* (2013.01); *F28G 1/12* (2013.01);
(Continued)

(58) Field of Classification Search
None
See application file for complete search history.

(56) References Cited

U.S. PATENT DOCUMENTS 6,099,398 A 8/2000 Jacobsen et al.
7,310,955 B2 12/2007 Hume et al.
(Continued)

FOREIGN PATENT DOCUMENTS

WO WO 2010119201 10/2010
WO WO 2010133784 11/2010
WO WO 2011010030 1/2011

OTHER PUBLICATIONS

English Machine Translation of WO 2010-119201 A1.*
PCT/FR2012/052432, International Search Report, dated Dec. 12, 2012 (3 pp).

*Primary Examiner* — Nicole Blan
(74) *Attorney, Agent, or Firm* — Elwood L. Haynes

(57) ABSTRACT

The invention relates to a device for dispensing one or more jets of cryogenic fluid comprising a fluid supply pipe supplying one or more fluid-dispensing nozzles arranged downstream of said pipe, in which the fluid flow section of the fluid supply pipe has a first diameter. According to the invention, the device for dispensing one or more jets of cryogenic fluid also comprises at least one plenum chamber which is arranged between the fluid supply pipe and the fluid-dispensing nozzle(s) and which is fluidly connected to both the pipe and the nozzle(s). The fluid flow section of
(Continued)

each plenum chamber has a second diameter greater than the first diameter of the fluid flow section of the fluid supply pipe.

12 Claims, 3 Drawing Sheets

(51) Int. Cl.
*B24C 1/00* (2006.01)
*B24C 1/08* (2006.01)

(52) U.S. Cl.
CPC .... *Y10T 137/0396* (2015.04); *Y10T 137/8593* (2015.04); *Y10T 137/85938* (2015.04)

(56) References Cited

U.S. PATENT DOCUMENTS

| | | | | |
|---|---|---|---|---|
| 7,316,363 | B2 | 1/2008 | Hume et al. | |
| 2004/0226580 | A1 | 11/2004 | Shiraishi | |
| 2005/0160552 | A1 | 7/2005 | Yoshida et al. | |
| 2006/0144969 | A1* | 7/2006 | Saripalli ..... | B05B 1/00 239/590.3 |

* cited by examiner

DEVICE FOR DISPENSING JETS OF CRYOGENIC FLUID, INCLUDING A PLENUM CHAMBER

CROSS REFERENCE TO RELATED APPLICATIONS

This application is a 371 of International Application PCT/FR2012/052432, filed Oct. 23, 2012, which claims priority to French Application No. 1160727, filed Nov. 24, 2011, the entire contents of which are incorporated herein by reference.

BACKGROUND

The invention relates to a device for dispensing jets of cryogenic fluid as well as an installation and a working method using the said jets, in particular jets of liquid nitrogen, under high pressure, in particular an installation and method for surface treatment, scouring, cleaning or descaling of materials, coated or not, such as metals, concrete, wood, polymers, ceramics and plastics materials or any other type of material.

Currently the surface treatment of materials, coated or not, in particular scouring, descaling or the like, is done essentially by blast cleaning, by spraying water at ultrahigh pressure (UHP), by sanding machine, by scaling hammer, by bush hammer or by chemical method.

However, when there must not be any water there, for example in a nuclear environment, or chemical product, for example because of drastic environmental constraints, only so-called "dry" working methods may be used.

However, in some cases, these "dry" methods are difficult to implement, are very laborious or difficult to use or give rise to additional pollution, for example because of the addition of shot or sand to be reprocessed thereafter.

One alternative to these technologies is based on the use of cryogenic jets under very high pressure as proposed by the documents U.S. Pat. No. 7,310,955 and U.S. Pat. No. 7,316,363. In this case, one or more jets of liquid nitrogen are used at a pressure of 300 to 4000 bar and at a cryogenic temperature between for example −100° and −200° C., typically approximately −140° C. and −160° C., which are dispensed by one or more nozzles driven or not in a rotary movement.

Normally, at a pressure of around 3500 bar, and for a nozzle diameter of around 300 μm, a jet of cryogenic fluid, in particular a jet of liquid nitrogen, typically has a maximum coherence length of around 15 to 18 cm. Coherence length means the length of the jet of cryogenic fluid over which the jet remains sufficiently concentrated so as to be visible after its escape through the nozzle.

However, the effective length of a jet of cryogenic fluid is also a very important characteristic since it corresponds to the maximum distance from the ejection nozzle beyond which the jet is no longer sufficiently concentrated to maintain its effectiveness in surface treatment, scouring, cleaning or descaling of the material being treated. The effective length is consequently less than or equal to the jet coherence length, which is the visible jet length.

In other words, the greater the effective length of the jet, the more effective the working method is for equal distance between the nozzle and the substrate being treated, and the more the method gains in efficiency, the said efficiency corresponding for example, in the case of a concrete descaling method, to the volume of concrete descaled per unit of time.

Thus, for a jet of cryogenic fluid to be effective and able to implement the required working method, it is necessary for the surface of the material treated to be situated, with respect to the outlet of the jet dispensing nozzle, at a distance less than or equal to the effective length and therefore less than the coherence length of the said jet. This effective jet length is in some cases, that is to say depending on the working method in question, small, that is to say around a few centimeters and typically between 5 and 15 mm for a jet of cryogenic fluid at a pressure of around 3500 bar dispensed by a nozzle with a diameter of around 300 μm. The tolerance in positioning of the jet dispensing nozzle with respect to the surface of the material is then problematic.

This is because it is technically difficult to maintain a strictly fixed distance between the jet dispensing nozzle and the surface of the material treated, whether the method be used manually or automatically, when the material has on its surface a defect in flatness or surface condition or roughnesses, that is to say a succession of hollows and projections, as is the case with concrete for example.

Thus, if the unevenness or the depth of the hollows has an excessively great amplitude, the areas of material treated situated at these defects or hollows are situated at a greater distance from the nozzle outlet, at which the jet has lost all or some of its effectiveness, which leads to a working method that is less effective in these areas. The working method is then less reliable, which is critical for some applications, such as the cleaning of contaminated parts in a nuclear environment, for which the least residue of pollution is not acceptable.

Moreover, an effective length of the jet that is insufficient makes a method of working implemented on a part in which features such as conduits or tracks are produced very difficult or even impossible. The problem posed is then even more critical since the bottom of the conduit or track being treated may be situated beyond the effective length of the jet, and because of this out of the range thereof, thus making the working method of low effectiveness, or even ineffective, in this area.

Moreover, the fact that the conventional jets of cryogenic fluid have a coherence length and therefore an effective length in general less than 20 cm poses a problem for the treatment, in particular cleaning, of heat exchangers used in for example installations of the power station, hydrocarbon desulphurisation factory, air or water treatment factory type, where the heat exchangers may have diameters greater than 40 cm. In this case, the part treated, that is to say the exchanger, consists itself of parts some of which are situated at more than 20 cm from the circumference of the said exchanger, and which it is necessary to be able to clean, which is not possible with the cryogenic fluid jets of the prior art.

The problem addressed is consequently proposing a method of working by cryogenic fluid jets that is improved, that is to say for which the drawbacks related not only to the limited coherence length but also to the limited effective length of the jets no longer exist or are greatly reduced, and thus making the working method using the said jets more reliable and more effective.

SUMMARY

In other words, the aim of the present invention is to propose a method for performing, more effectively and with better efficiency, the surface treatment of scouring, cleaning or descaling materials, coated or not, such as metals, concrete, wood, polymers, ceramics and plastics materials or any other type of material, in particular a material where the surface has unevenness or roughnesses or a part in which features are formed, or a part itself consisting of parts that are difficult to access.

The solution of the invention is thus a device for dispensing one or more jets of cryogenic fluid comprising a fluid-feed pipe supplying one or more fluid-dispensing nozzles arranged downstream of the said pipe, the fluid-feed pipe having a cross section of flow of the fluid of a first diameter, characterised in that it further comprises at least one plenum chamber arranged between the fluid-feed pipe and the fluid-dispensing nozzle or nozzles, while being fluidically connected to the said fluid-feed pipe and to the fluid-dispensing nozzle or nozzles, each plenum chamber having a cross section of flow of fluid having a second diameter greater than the first diameter of the cross section of flow of fluid of the fluid-feed pipe.

This is because the inventors of the present invention have shown that such a plenum chamber made it possible to make a flow of cryogenic fluid laminar, that is to say to make it more laminar or in an equivalent fashion less turbulent, by virtue of the use of a cross section of flow of fluid within this plenum chamber with a larger dimension than that of the cryogenic fluid feed pipe.

The device of the invention then makes it possible to dispense one of more cryogenic fluid jets with an increased coherence length, typically at least 19 cm, preferably greater than or equal to 20 cm, and this with an also increased effective length, which may even in some cases achieve the same values, compared with a device according to the prior art not provided with such a plenum chamber, all other conditions being equal otherwise.

The present invention thus solves the problems disclosed previously by proposing a device able to increase not only the coherence length of the jets of cryogenic fluid dispensed and used for a working method, but also to increase the effective length of the said jets.

Moreover, according to the embodiment in question, the invention may comprise one or more of the following features:

the plenum chamber has a cross section of flow of fluid with a diameter of between 2 and 6 mm, preferably between 3 and 5 mm;

the plenum chamber has a length of between 20 and 100 mm, preferably between 50 and 70 mm;

the plenum chamber is formed by a material suited to cryogenic temperatures, advantageously stainless steel, preferably stainless steel of the 316 or 316L type;

the device for dispensing one or more jets of cryogenic fluid comprises a single plenum chamber directly connected to the end of the fluid-feed pipe by means of a connection;

the device for dispensing one or more jets of cryogenic fluid further comprises a nozzle-holder tool connected to the end of the fluid-feed pipe by means of a connection, the said nozzle-holder tool supporting at least one plenum chamber arranged between the nozzle-holder tool and the fluid-dispensing nozzle or nozzles;

the device for dispensing one or more jets of cryogenic fluid further comprises a nozzle-holder tool provided with means for rotating the said nozzle-holder tool around the axis of the fluid-feed pipe so as to confer a circular movement on the fluid-dispensing nozzle or nozzles.

Moreover, the invention concerns an installation for treatment by one or more jets of cryogenic fluid, comprising a source of fluid at cryogenic temperature under high pressure fluidically connected to a fluid-feed pipe supplying one or more nozzles for dispensing one or more jets of fluid at cryogenic temperature at high pressure, characterised in that it also includes a device according to the invention.

According to another aspect, the invention relates to a working method using one of more jets of cryogenic fluid dispensed by means of a device according to the invention in order, by means of one or more jets of pressurised cryogenic fluid, to perform a surface treatment, scouring, cleaning or descaling of a material.

The jet or jets of cryogenic fluid dispensed by the fluid-dispensing nozzle or nozzles preferably have a temperature below −140° C. and a pressure of at least 300 bar.

Advantageously, the cryogenic fluid used is liquid nitrogen.

According to one embodiment of the invention, the part treated is a heat exchanger. The part treated preferably has at least one characteristic dimension greater than or equal to 20 cm.

DESCRIPTION OF THE PREFERRED EMBODIMENTS

Figure 1:
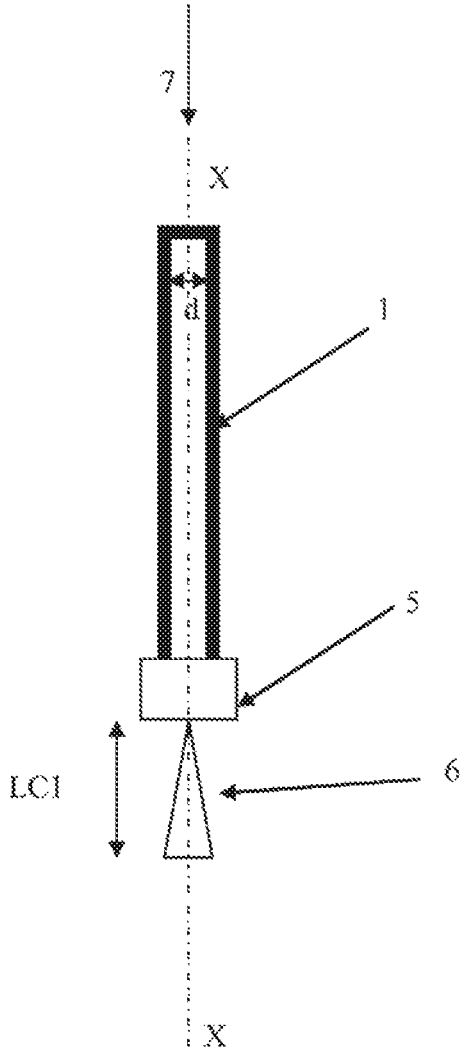
Figure 1 Prior Art
FIG. 1 shows schematically a conventional device for dispensing a jet of cryogenic fluid without use of the device of the invention.

The invention will now be better understood by means of the following detailed description given with reference to the accompanying figures, among which:

FIG. 1 shows schematically a device for dispensing a jet of cryogenic fluid 6 comprising a pipe 1 for feeding a fluid (arrow 7), the cross section of fluid flow of which has a diameter d, supplying a nozzle 5 for dispensing fluid arranged downstream of the said pipe 6. In other words, the diameter d is the inside diameter of the pipe 1.

The fluid 7 is a cryogenic fluid at high pressure emanating from a source of fluid (not shown), such as a compressor, a tank, a heat exchanger, a feed line, one or more gas bottles or the like, supplying the upstream end of the fluid pipe 1. The pipe 1 is therefore fluidically connected to the source of fluid 7.

Normally, this pipe is a tube the cross section of which is advantageously circular in shape. This tube may be produced from any type of suitable material, preferably stainless steel for its mechanical properties. The thickness of the wall constituting the pipe 1 is defined so as to withstand the mechanical stresses resulting from the flow of a cryogenic fluid at high pressure, typically the said thickness is around the inside diameter of the pipe, i.e. the cross section of flow of fluid of diameter d. As can be seen in FIG. 1, a fluid-dispensing nozzle 5 is fluidically connected to the pipe 1 so that it dispenses a jet of cryogenic fluid 6, the propagation axis of which is aligned with the central axis XX of the pipe 1 and the coherence length of which is denoted LC1. The nozzle 5 is connected to the pipe 1 by means of a connection of the UHP 2 water jet type.

However, the coherence length LC1, typically between 15 and 18 cm, may prove to be insufficient for many applications, in particular for applications for treating a part made from a material the surface of which has unevenness or roughnesses, or in which features are formed, in particular when these features are formed along a dimension of the treated part greater than the coherence length LC1. Moreover, this also poses a problem for applications in cleaning heat exchangers, these exchangers consisting of parts that are difficult to access, in particular parts situated at more than 20 cm from the circumference of the exchanger.

In order to remedy this, according to the first invention, in a device for dispensing a jet of cryogenic fluid 6 according to the prior art, a so-called plenum chamber 4 is incorporated, able to increase the coherence length LC1 of the jet 6 to a coherence length LC2 greater than LC1.

Figure 2:
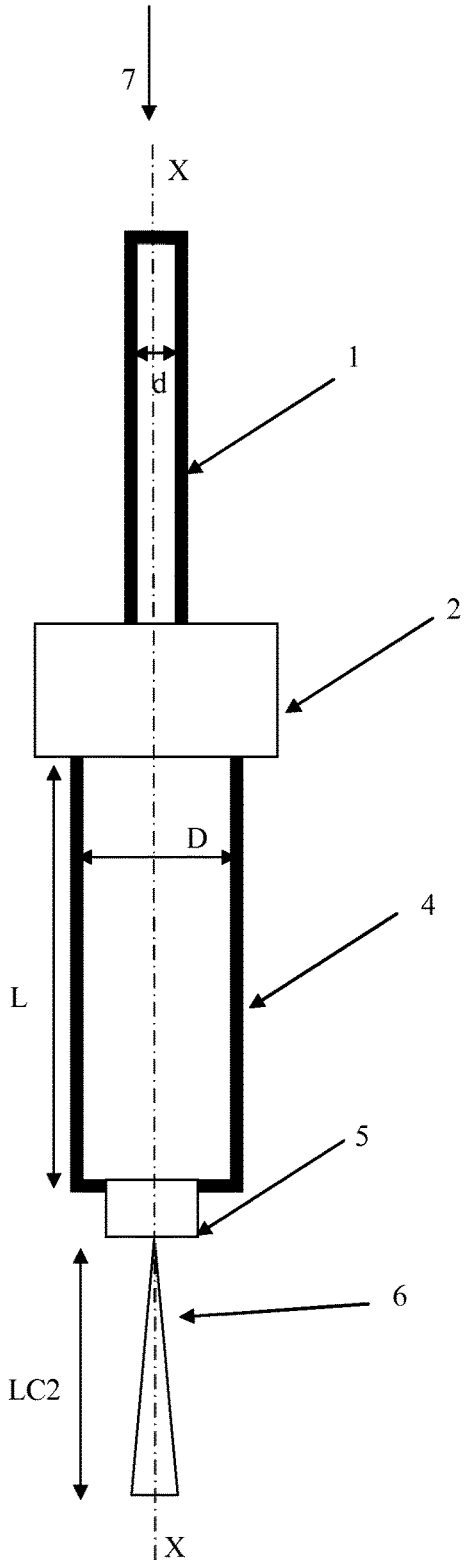
FIG. 2 shows schematically a device for dispensing a jet of cryogenic fluid according to one embodiment of the invention.

As can be seen in FIG. 2, which shows schematically an embodiment of the invention, the plenum chamber 4 is arranged between the fluid-feed pipe 1 and the fluid-dispensing nozzle 5. The pipe 1 is fluidically connected to the plenum chamber 4, the said chamber being fluidically connected to the fluid-dispensing nozzle 5.

Plenum chamber means a device through which the fluid 7 flows, able to make the flow of the said fluid laminar, that is to say to make it more laminar or in an equivalent fashion less turbulent, by virtue of the use of a cross section of fluid flow with a greater dimension than that of the fluid-feed pipe 1. More precisely, the flow of fluid 7 through the plenum chamber 4 will cause a modification to the dynamic characteristics of the jet of cryogenic fluid 6 as it emerges from the nozzle 5, making it less turbulent, i.e. decreasing its Reynolds number. The result is an increase in the coherence length of the jet of cryogenic fluid 6 to a value LC2 greater than the value LC1 of the coherence length of the jet of cryogenic fluid obtained without the device of the invention.

Advantageously, the plenum chamber 4 is a part of revolution in which there is formed a conduit with a circular cross section having a cross section of fluid flow of diameter D and length L. In other words, the diameter D is the inside diameter of the plenum chamber 4. The plenum chamber 4 is formed from a material suited to the passage of a cryogenic fluid under high pressure, advantageously stainless steel, preferably stainless steel of the 316 type.

In all cases, and in accordance with the invention, the cross section of fluid flow of the plenum chamber 4 has a diameter D greater than the diameter d of the cross section of fluid flow of the fluid-feed pipe 1.

By way of example, if the plenum chamber 4 is connected to a fluid-feed pipe 1 with an inside diameter of 2.1 mm, for example a so-called ¼" tube with an outside diameter of 6.35 mm, the inside diameter D of the chamber is greater than 2.1 mm.

The plenum chamber 4 has a cross section of fluid flow with a diameter D of between 2 and 6 mm, preferably between 3 and 5 mm, and a length L of between 20 and 100 mm, preferably between 50 and 70 mm. These dimensions are adapted according to the application sought and the coherence length of the fluid jet 6 required.

According to a particular embodiment of the invention, as illustrated in FIG. 2, a single plenum chamber 4 is directly connected to the end of the fluid-feed pipe 1 by means of a connection 2 and is situated directly upstream of the fluid-dispensing nozzle 5. In the light of the cryogenic fluid pressures involved, the connection between the plenum chamber 4 and the end of the pipe 1 is advantageously provided by a threaded connection. The connection between the plenum chamber 4 and the nozzle 5 is obtained by means of a tapping produced in the downstream part of the plenum chamber 4 and onto which the nozzle 5 is screwed. The axis of the plenum chamber 4 is aligned with the axis XX of the fluid-feed pipe 1. In this case, the device of the invention is able to dispense a single fixed jet of cryogenic fluid 6, the coherence length of which, denoted LC2 in FIG. 2, is greater than the coherence length LC1 of a jet of fluid dispensed by a device according to the prior art.

Figure 3:
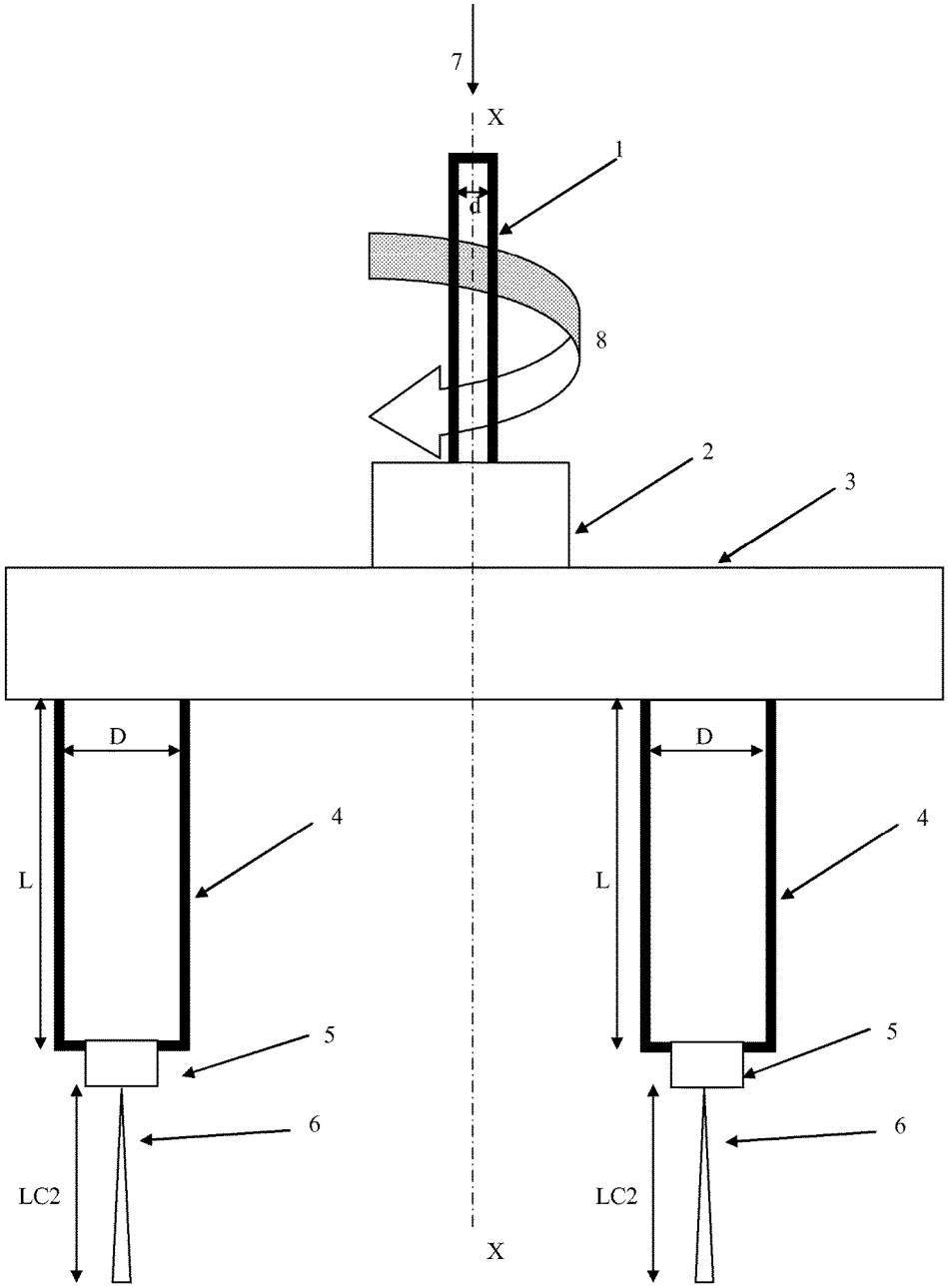
FIG. 3 shows schematically a device for dispensing one or more jets of cryogenic fluid according to another embodiment of the invention.

According to another embodiment illustrated in FIG. 3, the device for dispensing one or more jets of cryogenic fluid 6 comprises one or more nozzles 5 dispensing one or more jets of cryogenic fluid 6. The nozzle or nozzles 5 are positioned eccentrically, that is to say off centre with respect to the axis XX of the fluid-feed pipe 1. In this case, a nozzle-holder tool 3 is connected to the end of the fluid-feed pipe 1 by means of a connection 2. This nozzle-holder tool 3 then supports one or more plenum chambers 4 arranged between the nozzle-holder tool 3 and the fluid-dispensing nozzle or nozzles 5. Naturally, when multiple cryogenic fluid jets 6 are dispensed, a plenum chamber 4 is arranged upstream of each cryogenic fluid dispensing nozzle 5. The device of the invention is thus able to dispense one or more jets of cryogenic fluid 6 the coherence length LC2 of which is greater than the coherence length LC1 of a jet of fluid dispensed by a device according to the prior art.

According to a particular embodiment, the device for dispensing one or more cryogenic fluid jets 6 comprises a nozzle-holder tool 3 provided with means for rotating the said tool about the axis XX of the pipe 1 so as to confer a circular movement on the fluid-dispensing nozzle or nozzles 5 and to obtain rotary jets (shown schematically by the arrow 8 in FIG. 3). Normally, the nozzle-holder tool 3 can be rotated by a set of gears, with or without transmission belt, moved by an electric or pneumatic motor by means of a first rotary transmission shaft or spindle connected to the motor, a box, a housing or a transmission chamber comprising a transmission mechanism with an internal set of gears and a second transmission shaft or spindle, here rotary, for its part connected to the movable tool 3 provided with plenum chambers 4 and nozzles 5.

Moreover, the solution of the invention also concerns a working method using a device according to the invention able to dispense one or more jets of cryogenic fluid 6, fixed or rotary, the coherence length of which is increased in order to implement a surface treatment, a scouring, a cleaning or a descaling of a material. The method of the invention is particularly advantageous for performing a surface treatment operation or the like on a material or a part the surface of which has unevenness or roughnesses or having at least one characteristic dimension of at least 20 cm, that is to say a width, height or length, in which features are produced. In particular, the solution of the invention is of great interest for cleaning heat exchangers with a large size, that is to say at least 40 cm, for which the constituent parts may be situated at more than 20 cm from the circumference of the exchangers. Preferably the jet or jets of cryogenic fluid used in the working method have a coherence length LC2 of at least 20 cm.

In the context of the invention, the fluid dispensed by the device of the invention is a fluid at cryogenic temperature and high pressure, in particular liquid nitrogen at a pressure above 1500 bar and a temperature below −140° C.

EXAMPLES

In order to demonstrate the efficacy of a device according to the invention for increasing the coherence length and effective length of a jet of cryogenic fluid and thereby minimising or even avoiding the problems related to this limited coherence length and efficacy length, tests were carried out in order to compare the jet coherence length obtained with a conventional device for dispensing a jet of cryogenic fluid, that is to say characterised by the absence of a plenum chamber (test according to the prior art), and a device for dispensing a jet of cryogenic fluid comprising one or more plenum chambers arranged between the nozzle and the fluid-feed pipe (tests according to the invention). These tests consisted essentially of measurements of the coherence length of the jets, this length corresponding to the visible jet length, which can easily be assessed. Naturally, an increase in the coherence length of a fluid jet also results in an increase in the effective length of the said jet.

The tests were carried out with jets of liquid nitrogen at a pressure of 3500 bar, a flow rate of 6 liters/min and a temperature of −155° C.

The system for supplying cryogenic fluid is a tube made from UHP 316L stainless steel with an outside diameter of 6.35 mm and an inside diameter d of 2.1 mm.

The device for dispensing a cryogenic fluid jet comprises a single plenum chamber and a single dispensing nozzle, as illustrated in FIG. 2, and does not use a system for rotating the jet.

Example 1: Cryogenic Fluid Dispensing Nozzle Diameter 305 μm

In this first series of tests, the device for dispensing the jet of cryogenic fluid situated downstream of the plenum chamber is a nozzle issuing from high-pressure water jet technology, provided with an ejection sapphire with a fluid passage diameter, that is to say the diameter of the outlet orifice, of 305 μm.

Table 1 gives the jet coherence lengths obtained during tests carried out with a plenum chamber with a length L of 60 mm and a diameter D of 4.2 mm (test N° 1), in comparison with the jet coherence lengths obtained during tests performed in the absence of such a plenum chamber (test N° 2).

As can be seen, the arrangement of a plenum chamber according to the invention between the fluid-feed pipe and the fluid-dispensing nozzle effectively leads to a coherence length of the jet of cryogenic fluid dispensed greater than that obtained without the device of the invention.

Table 2 gives the jet coherence lengths obtained during the use of a plenum chamber with a diameter D of 4.2 mm and various lengths L, and table 3 gives the jet coherence lengths obtained during the use of plenum chambers with various diameters D and length L of 60 mm. By way of indication, table 4 gives the Reynolds numbers of the cryogenic fluid jets obtained during the use of plenum chambers with various diameters D and a length L of 60 mm.

As can be seen, the arrangement of a plenum chamber between the fluid-feed pipe and the fluid-dispensing nozzle, in accordance with the invention, effectively leads to coherence lengths of the jets of cryogenic fluid dispensed greater than the coherence length of the jet of fluid dispensed by a device according to the prior art, that is to say with a plenum chamber, for the various geometries of plenum chambers tested. Thus the invention also makes it possible to increase the effective length of the jet of cryogenic fluid.

In the light of the cryogenic fluid jet coherence lengths obtained during these tests, it should be noted that applying the invention is particularly advantageous when the part being treated comprises at least one characteristic dimension, that is to say a length, width or height, the said characteristic dimension being around 20 cm and more, or when the part being treated itself comprises parts situated at more than 20 cm from the circumference of the said part being treated.

Furthermore, table 4 shows that the increase in the coherence length of the jet of cryogenic fluid is accompanied by a reduction in the Reynolds number of the said jet and consequently a laminarisation of the said jet, which further demonstrates the advantage of the invention in solving the previously mentioned problems.

Moreover, the results presented in tables 2 and 3 show that the increase in the coherence length tends to reach a ceiling value when the diameter D of the plenum chamber increases or when the length of the plenum chamber L increases. It is therefore not necessary to indefinitely increase the dimensions L and D of the plenum chamber, and the dimensions of the chamber thus remain reasonable. For optimum functioning of the solution of the invention, the diameters and lengths of the plenum chamber or chambers will therefore be adjusted so that the cross section of fluid flow D has a diameter of between 2 and 6 mm and the length L of the said cross section is between 20 and 100 mm.

In the context of the invention, in the light of the results of the measurements of coherence length given in the following tables, the diameter D of the cross section of fluid flow of the plenum chamber is preferentially between preferably 3 and 5 mm, and the length L of the cross section of fluid flow of the plenum chamber is preferentially between 50 and 70 mm, so as to dispense one or more jets of cryogenic fluid having a coherence length LC2 of at least 20 cm. Furthermore these dimensions make it possible to keep a device for dispensing one or more jets of cryogenic fluid remaining of reasonable size, so that it can easily be used in an industrial work installation using the cryogenic fluid jet or jets dispensed.

TABLE 1

| Ejection diameter 305 μm | Test N° 1 - Invention | Test N° 1 - Prior art |
|---|---|---|
| Coherence length of jet | 25 cm | 18 cm |

TABLE 2

| Ejection diameter 305 μm | Diameter of chamber D = 4.2 mm | | | |
|---|---|---|---|---|
| Length of chamber L | 20 mm | 40 mm | 60 mm | 500 mm |
| Length of coherence jet | 19 cm | 22 cm | 25 cm | 25 cm |

TABLE 3

| Ejection diameter 305 μm | Length of chamber L = 60 mm | | | |
|---|---|---|---|---|
| Length of chamber D | 2.1 mm | 3.2 mm | 4.2 mm | 5.5 mm |
| Length of coherence jet | 19 cm | 21 cm | 25 cm | 25 cm |

TABLE 4

| Ejection diameter 305 μm | Length of chamber L = 60 mm | | | |
|---|---|---|---|---|
| Length of chamber D | 2.1 mm | 3.2 mm | 4.2 mm | 5.5 mm |
| Reynolds number | 97627 | 64067 | 48813 | 37276 |

Example 2: Cryogenic Fluid Dispensing Nozzle Diameter 432 μm

A second series of tests was performed, under the same conditions as before, but this time with a nozzle provided with an ejection sapphire with a fluid passage diameter of 432 μm, the objective being to verify that the results obtained previously remain valid with an ejection nozzle with characteristics different from the first.

Table 5 give the jet coherence lengths obtained during the use of a plenum chamber with a diameter D of 4.2 mm and various lengths L. Table 6 gives the jet coherence lengths obtained during the use of plenum chambers with various diameters D and a length L of 60 mm.

Thus, as with a nozzle with an ejection diameter of 305 μm, it turns out that, for a nozzle with an ejection diameter of 432 μm, the diameter D of the cross section of fluid flow of the plenum chamber is preferentially between preferably between 3 and 5 mm, and the length L of the cross section of fluid flow of the plenum chamber is preferentially between 50 and 70 mm, so as to dispense one or more jets of cryogenic fluid having a coherence length LC2 of at least 20 cm.

It should be noted that, with a nozzle with an ejection diameter of 432 μm, the jet coherence length is greater than with a nozzle with an ejection diameter of 305 μm, and this with the same plenum chamber. This is because, with a greater ejection diameter, the flow rate at constant pressure is greater, which leads to a greater length of coherence jet.

TABLE 5

| Ejection diameter 432 μm | Diameter of chamber D = 4.2 mm | | | |
|---|---|---|---|---|
| Length of chamber L | 20 mm | 40 mm | 60 mm | 500 mm |
| Length of coherence jet | 26 cm | 30 cm | 33 cm | 32 cm |

TABLE 6

| Ejection diameter 432 μm | Length of chamber L = 60 mm | | | |
|---|---|---|---|---|
| Length of chamber D | 2.1 mm | 3.2 mm | 4.2 mm | 5.5 mm |
| Length of coherence jet | 21 cm | 28 cm | 33 cm | 33 cm |

Example 3: Method for Descaling Concrete by Cryogenic Fluid Jet

In order to demonstrate the contribution of the present invention in improving the efficacy and efficiency of the method for working by cryogenic fluid jets, tests were carried out on the descaling of concrete using a cryogenic fluid jet dispensed by a device according to the invention. The performances obtained were compared with those obtained with a cryogenic fluid jet dispensed with a device according to the prior art, that is to say without a plenum chamber, all other test conditions being identical.

The descaling method is performed with liquid nitrogen at a pressure of around 3500 bar, a temperature of around −153° C. and a flow rate of around 7 liters/min.

The liquid nitrogen is dispensed by a single nozzle with an ejection diameter of 330 μm, rotated at a speed of approximately 1400 revolutions/min by means of a nozzle-holder tool provided with means for rotating the said tool about the axis of the fluid-feed pipe, so as to confer a circular movement on the fluid-dispensing nozzle. The nozzle-holder tool moves at a speed of approximately 130 cm/min. A detailed description of this rotation tool is given in the document WO-A-2011010030.

The material descaled is concrete with a fine and even granulometry, a typical application of which is the formation of small kerbstones for gardens. The structure of this concrete assists the making of comparative measurements.

The nozzle dispensing the liquid nitrogen is positioned at a distance of approximately 10 mm with respect to the surface of the concrete being treated.

Table 7 presents a comparison of the results obtained during the descaling of the concrete according to the prior art, that is to say without a plenum chamber (Test N° 3), and with a device according to the invention, that is to say with a plenum chamber, the chamber used having a length L of 60 mm and a diameter D of 4.2 mm (Test N° 4).

It is found that the depth of concrete descaled is considerably increased with the use of a plenum chamber, which represents a great efficacy of the method.

Thus, in the context of the method implemented, the invention makes it possible to increase the effective length of the jet to between 15 and 20 mm, typically at least 17 mm, in comparison with an effective length of between 5 and 15 mm, typically less than 13 mm, without a plenum chamber. The invention also makes it possible to increase the volume of concrete descaled per unit of time. In general terms, the use of the invention leads to a gain of around 260% on the concrete descaling performances.

These descaling tests therefore demonstrate that an increase in the coherence length of a cryogenic fluid jet is accompanied by an increase in the effective length of the said jet since, at a constant distance between nozzle and substrate, the efficacy of the jet is greater.

TABLE 7

| Nozzle-substrate distance = 10 mm | Depth of concrete descaled | Width of concrete descaled | Volume of concrete descaled per minute |
|---|---|---|---|
| Test N° 3 - Prior art | 2 mm | 52 mm | 135 $cm^3$/min |
| Test N° 4 - Invention | 7 mm | 50 mm | 490 $cm^3$/min |

All the tests performed therefore demonstrate clearly the efficacy of the invention which, without making the device for dispensing the said jets more complex, makes it possible to significantly increase the coherence length and therefore increase the effective length of the cryogenic fluid jet or jets dispensed by the device of the invention in comparison with a conventional device according to the prior art, every other operating condition being equal, and therefore to increase the efficacy of the working method using the said jets.

The main application of the present invention is a method for surface treatment, scouring, cleaning or descaling materials, coated or not, such as metals, concrete, wood, polymers, ceramics and plastics materials or any other type of material.

It will be understood that many additional changes in the details, materials, steps and arrangement of parts, which have been herein described in order to explain the nature of the invention, may be made by those skilled in the art within the principle and scope of the invention as expressed in the appended claims. Thus, the present invention is not intended to be limited to the specific embodiments in the examples given above.

The invention claimed is:

1. A device for dispensing one or more jets of cryogenic fluid, comprising a fluid-feed pipe supplying one or more fluid-dispensing nozzles arranged downstream of the said pipe, the fluid-feed pipe having a cross section of fluid flow with a first diameter (d) wherein at least one plenum chamber arranged between the fluid-feed pipe and the fluid-dispensing nozzle or nozzles, while being fluidically connected to the said fluid-feed pipe and to the fluid-dispensing nozzle or nozzles, each at least one plenum chamber having a cross section of fluid flow having a second diameter (D) greater than the first diameter (d) of the cross section of fluid flow of the fluid-feed pipe, wherein the fluidic connection between the fluid-feed pipe and the at least one plenum chamber is configured to make the fluid flow less turbulent, wherein a nozzle-holder tool connected to the end of the fluid-feed pipe by means of a connection, the said nozzle-holder tool supporting the at least one plenum chamber arranged between the nozzle-holder tool and the fluid-dispensing nozzle or nozzles.

2. The device according to claim 1, wherein the at least one plenum chamber has a cross section of flow of fluid with the second diameter (D) of between 2 and 6 mm.

3. The device according to claim 1, wherein the at least one plenum chamber has a length (L) between 20 and 100 mm.

4. The device according to claim 1, wherein the at least one plenum chamber is formed by a material suited to cryogenic temperatures.

5. An installation for treating by means of one or more cryogenic fluid jets, comprising a source of fluid at cryogenic temperature and under high pressure fluidically connected to a fluid-feed pipe supplying one or more nozzles dispensing in one or more jets of fluid at cryogenic temperature and under high pressure, wherein it further includes a device according to claim 1.

6. A working method using one or more cryogenic fluid jets dispensed by means of a device according to claim 1, in order by means of one or more pressurized cryogenic fluid jets, to perform a surface treatment, scouring, cleaning or descaling of a material.

7. The working method according to claim 6, wherein the cryogenic fluid jet or jets dispensed by the fluid-dispensing nozzle or nozzles have a temperature of below −140° C. and a pressure of at least 300 bar.

8. The working method according to claim 6, wherein the cryogenic fluid used is liquid nitrogen.

9. A device for dispensing one or more jets of cryogenic fluid, comprising a fluid-feed pipe supplying one or more fluid-dispensing nozzles arranged downstream of the said pipe, the fluid-feed pipe having a cross section of fluid flow with a first diameter (d) wherein at least one plenum chamber arranged between the fluid-feed pipe and the fluid-dispensing nozzle or nozzles, while being fluidically connected to the said fluid-feed pipe and to the fluid-dispensing nozzle or nozzles, each at least one plenum chamber having a cross section of fluid flow having a second diameter (D) greater than the first diameter (d) of the cross section of fluid flow of the fluid-feed pipe, wherein the fluidic connection between the fluid-feed pipe and the at least one plenum chamber is configured to make the fluid flow less turbulent, further comprising a nozzle-holder tool provided with means for rotating the said nozzle-holder tool around the axis of the fluid-feed pipe so as to confer a circular movement on the fluid-dispensing nozzle or nozzles.

10. The device according to claim 9, wherein the at least one plenum chamber has a cross section of flow of fluid with the second diameter (D) of between 2 and 6 mm.

11. The device according to claim 9, wherein the at least one plenum chamber has a length (L) between 20 and 100 mm.

12. The device according to claim 9, wherein the at least one plenum chamber is formed by a material suited to cryogenic temperatures.

* * * * *